US005880660A

United States Patent [19]

Iwasaki et al.

[11] Patent Number: 5,880,660

[45] Date of Patent: Mar. 9, 1999

[54] CATHODE RAY TUBE APPARATUS

[75] Inventors: Katsuyo Iwasaki, Hyogo; Kenichiro Taniwa; Masanobu Honda, both of Osaka, all of Japan

[73] Assignee: Matsushita Electronics Corporation, Osaka, Japan

[21] Appl. No.: 993,423

[22] Filed: Dec. 18, 1997

[30] Foreign Application Priority Data

Dec. 27, 1996 [JP] Japan ..... 8-351280

[51] Int. Cl.[6] ..... H01H 1/00

[52] U.S. Cl. ..... 335/213; 335/210; 313/440

[58] Field of Search ..... 335/210–214; 313/430, 440, 412, 413

[56] References Cited

U.S. PATENT DOCUMENTS

| | | | |
|---|---|---|---|
| 4,041,428 | 8/1977 | Kikuchi et al. | 335/210 |
| 4,246,560 | 1/1981 | Shimizu et al. | 335/212 |
| 4,376,924 | 3/1983 | Gross et al. | 335/210 |
| 4,703,232 | 10/1987 | Nieuwendijk et al. | 315/370 |
| 5,204,648 | 4/1993 | Jei | 335/210 |
| 5,204,649 | 4/1993 | Togane et al. | 335/210 |
| 5,378,961 | 1/1995 | Shiro et al. | 313/440 |
| 5,449,969 | 9/1995 | Washburn | 313/440 |
| 5,455,483 | 10/1995 | Azzi et al. | 313/440 |

FOREIGN PATENT DOCUMENTS

| | | |
|---|---|---|
| 0 700 067 | 3/1996 | European Pat. Off. . |
| 2 689 679 | 10/1993 | France . |
| 52-100825 | 8/1977 | Japan . |

*Primary Examiner*—Renee S. Luebke
*Assistant Examiner*—Tuyen T. Nguyen
*Attorney, Agent, or Firm*—Merchant, Gould, Smith, Edell, Welter & Schmidt, P.A.

[57] ABSTRACT

A cathode ray tube apparatus comprising: a deflection yoke comprising a horizontal deflection coil that forms the pin cushion distortion as a whole; a vertical deflection coil that forms the barrel distortion as a whole: a resin frame provided around the periphery of the horizontal deflection coil, which insulates and fastens the horizontal deflection coil and the vertical deflection coil; and a ferrite core provided around the periphery of the vertical deflection coil to strengthen the magnetic flux and the length of part of cone portion of the horizontal deflection coil at the side of the screen whose winding angle is not less than 0 degree nor more than 30 degree with respect to the reference line is 25 mm or longer as measured from the reference line. This cathode ray tube apparatus can correct the pin cushion distortion of raster in the upper-and-lower side of the picture for flattened and increased deflection angle cathode ray tubes with the deflection yoke itself.

4 Claims, 6 Drawing Sheets

CATHODE RAY TUBE APPARATUS

FIELD OF THE INVENTION

The present invention relates to a cathode ray tube apparatus used for a monitor, a television receiver and the like.

BACKGROUND OF THE INVENTION

Hereinafter, a conventional cathode ray tube apparatus used for a computer display monitor, a television receiver and the like will be explained referring to FIG. 1. FIG. 1 is a view showing a cathode ray tube apparatus of this invention. However, the general construction of a cathode ray tube apparatus of this invention is same as that of the conventional cathode ray tube apparatus. Therefore, a conventional cathode ray tube apparatus will be explained referring to FIG. 1. FIG. 1 is a partially-sectional side view showing a cathode ray tube apparatus, with the upper portion of FIG. 1 being a sectional view showing a cathode ray tube apparatus. In FIG. 1, a cathode ray tube 1 comprises a panel 2 and a funnel 3 connected to the panel 2. Inside the panel 2, a phosphor screen (not shown in FIG. 1) is provided and a shadow mask (not shown in FIG. 1) is provided. Electron guns (not shown in FIG. 1), which are in-line aligned, are provided inside of a neck portion 4 of the funnel 3.

In FIG. 1, 11 indicates a deflection yoke that deflects an electron beam to the horizontal direction and to the vertical direction. 12 indicates a central processing unit (CPU) that controls the purity and the convergence in the mid section of the picture and comprises 2P (a magnet that generates a double pole magnetic field), 4P (a magnet that generates a four pole magnetic field) and 6P (a magnet that generates a six pole magnetic field). 2P, 4P and 6P are not shown in FIG. 1. 13 indicates a reference line. The reference line is a virtual line and is reference of the tube axial direction of the cathode ray tube. An electron beam actually is emitted from the side of the electron gun, however, it is equivalent to an electron beam is emitted from the reference line 13 and extends at an angle with respect to the longitudinal axis. "A" indicates a deflection angle. When a cathode ray tube apparatus has a 90° deflection angle and comprises a round type panel having a small curvature, it is comparatively easy to correct a distortion of the picture in the upper-and-lower side by a self-convergence system that corrects the distortion of the picture automatically with the deflection yoke 11.

Hereinafter, the reason for the above-mentioned easy automatic correction will be explained referring to FIGS. 5 and 6. FIG. 5 shows the relationship between a position of P along the axis of cathode ray tube and a magnetic field H which is generated by a deflection yoke. The magnetic field H indicates a ratio of the magnetic field in the position of P along the axis of cathode ray tube to the magnetic field in the whole area of the deflection area. The horizontal axis P is divided into three parts, a screen side part 5 to the right side of point "b", a mid section 6 between point "a" and point "b" and an electron gun side 7 to the left side of point "a", with respect to the contribution ratio of magnetic field to each property such as the convergence and the raster.

FIG. 6 shows the relationship between a position of P along the longitudinal axis of the cathode ray tube and a contributing ratio of magnetic field R to each property, such as the convergence coma 8, the convergence astigmatism 9 and the raster distortion 10. The contributing ratio R is the portion of the magnetic field H that influences each property. The relationships shown in FIGS. 5 and 6 are well-known. According to the relationship shown in FIGS. 5 and 6, when a length of the deflection coil is constant, the pin cushion distortion of raster is greatly influenced by the magnetic field at the side of screen side 5. Further, it is well-known that the pin cushion distortion of raster in the upper-and-lower side is greatly influenced by the magnetic distortion in the horizontal magnetic field. In addition, it is also well-known that the pin cushion distortion of raster in the right-and left side is greatly influenced by the magnetic distortion in the vertical magnetic field.

As above-mentioned, the pin cushion distortion in the horizontal magnetic field, especially at the screen side 5, is strengthened beforehand, and the size of the area of the horizontal magnetic field at the screen side 5 is made as small as possible. As a result, the automatic correction of the pin cushion distortion of raster in the upper-and lower side was conducted comparatively easily.

FIG. 7 shows a case in which the pin cushion distortion of raster in the upper-and-lower side is corrected automatically. In FIG. 7, the pin cushion distortion indicated by the broken line is corrected automatically to be the horizontal line indicated by the arrow.

However, in comparison with a panel of a conventional type, a recent panel such as the 2R type is flattened. Further, the deflection angle is enlarged to be 100 degrees or 110 degrees. The picture tube having the above-mentioned panel has a problem such that the pin cushion distortion of raster in the upper-and-lower side is strengthened further, and therefore it is difficult to correct the distortion automatically.

Accordingly, there are some methods to improve the above-mentioned problems. For example, as shown in FIG. 8, a method in which a magnet 22 is attached to the upper and lower parts of the opening portion of the deflection yoke 21, and a method as disclosed in publication of Japanese Patent Application Tokkai-Sho 59-3849 in which the size of the coil is miniaturized and a deflection center is shifted as close as possible to the neck portion of cathode ray tube to decrease an effective deflection angle of the electron beam, have been proposed.

However, even when the above-mentioned methods are employed, it is still difficult to conduct the automatic correction. Therefore the correction with the electrical circuit is required. In case of the correction with the electrical circuit which is conducted by controlling the deflecting current wave form, when the horizontal deflecting frequency is changed, the degree of the correction of the raster does not become to be optimum, or the convergence is changed, therefore, it is impossible to correspond with the multi-scan.

SUMMARY OF THE INVENTION

The present invention aims at solving the above-mentioned problems of the prior art. The object of the present invention is to provide a cathode ray tube apparatus that can correct automatically the pin cushion distortion of raster in the upper-and-lower side of the flattened panel and that of the picture tube whose deflection angle is enlarged, with the deflection yoke, by increasing the length of the horizontal coil at the side of the screen.

In order to achieve the above-mentioned objects, this invention provides a cathode ray tube apparatus used as an in-line aligned color picture tube comprising: a deflection yoke comprising a horizontal deflection coil that forms the pin cushion distortion as a whole and a vertical deflection coil that forms the barrel cushion distortion as a whole; and a ferrite core provided around the periphery of the vertical deflection coil to strengthen the magnetic flux.

It is preferable that the cathode ray tube apparatus comprises a resin frame provided around the periphery of the horizontal deflection coil, which insulates and connects the horizontal deflection coil and the vertical deflection coil.

Further, it is preferable that the length of the cone part of the horizontal deflection coil of the cathode ray tube apparatus of this invention is 25 mm or longer measured from the reference line. The winding angle of the cone portion of the horizontal deflection coil at the side of the screen with respect to the reference line is not less than 0 degree nor more than 30 degrees.

According to the above-mentioned cathode ray tube apparatus, the length of the horizontal deflection coil at the side of the screen which is effective in correcting the distortion of raster in the upper-and-lower side of the picture is enlarged. Therefore the pin cushion distortion is strengthened and the area of the magnetic field where the pin cushion distortion is strengthened can be enlarged. As a result, even in the flattened panel and the picture tube whose deflection angle is enlarged, the distortion of raster in the upper-and-lower side of the picture can be corrected automatically with the deflection yoke.

It is preferable that the distance between the end of the ferrite core at the side of the screen and the reference line is less than 25 mm. According to this constitution, the pin cushion distortion can be further strengthened.

It is also preferable that a space is provided between the ferrite core at the side of the screen and the cone part of the horizontal deflection coil at the side of the screen to provide some part of the cone part of the horizontal deflection coil which is not covered with the ferrite core. According to this construction, the pin cushion distortion can be strengthened.

DETAILED DESCRIPTION OF THE PREFERRED EMBODIMENT

Hereinafter, an example of a cathode ray tube apparatus of this invention will be explained referring to the figures. The general construction shown in FIG. 1 is the same as that of the conventional type, and therefore the explanation of FIG. 1 will be omitted.

Figure 1:
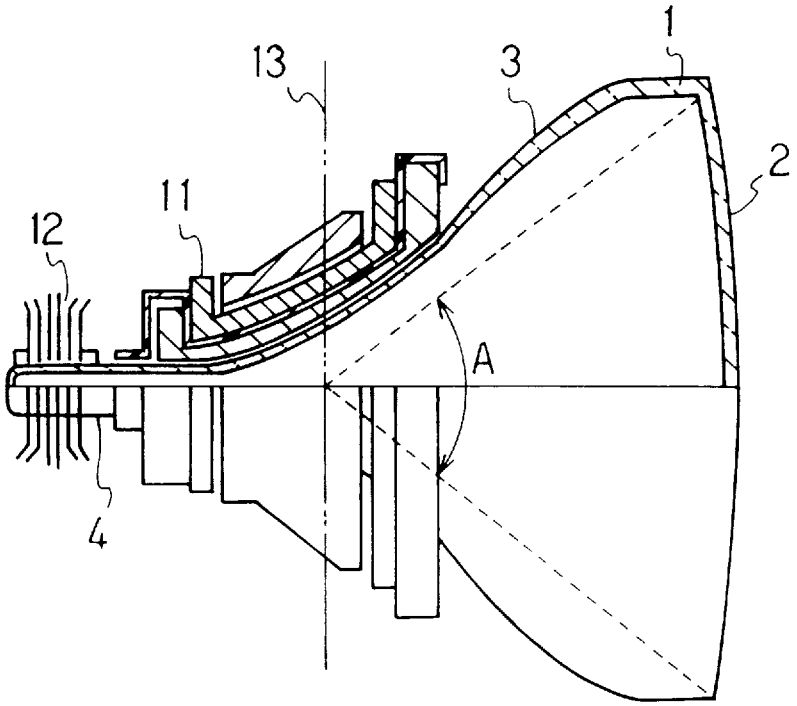
FIG. 1 is a side view showing an example of cathode ray tube of this invention.
Figure 2:
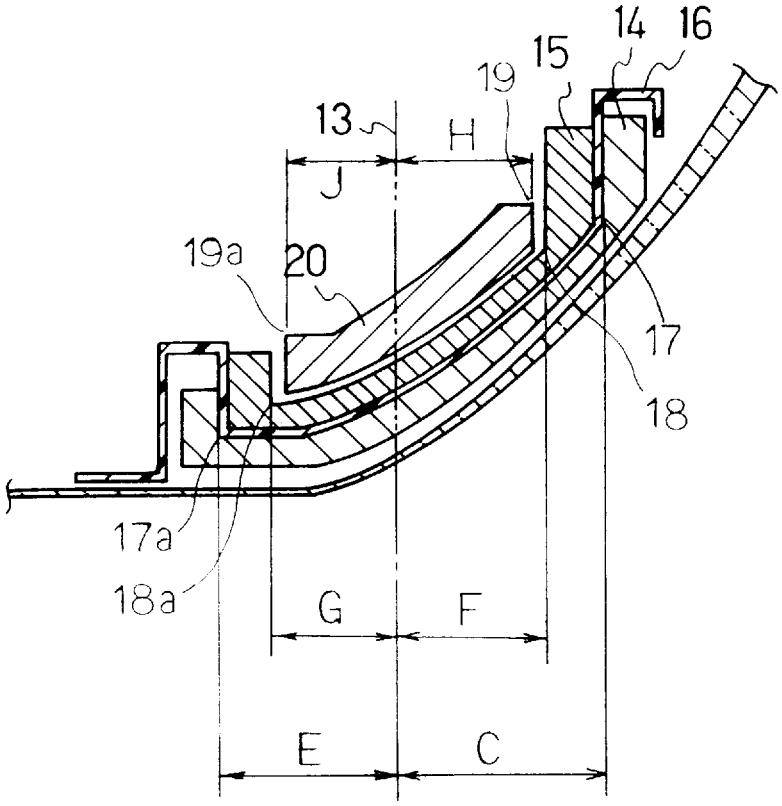
FIG. 2 is an enlarged view showing a deflection yoke shown in FIG. 1.

FIG. 2 is an enlarged view showing a deflection yoke 11 shown in FIG. 1. In FIG. 2, 14 indicates a horizontal deflection coil and 15 indicates a vertical deflection coil. 16 indicates a resin frame that insulates and connects the horizontal deflection coil and the vertical deflection coil. 20 indicates a ferrite core provided around the periphery of the vertical deflection coil 15. The horizontal deflection coil 14, the vertical deflection coil 15 and the ferrite core 20 form the trumpet-shaped cone part of the deflection yoke.

In the deflection yoke 11, the horizontal deflection coil 14 forms the pin cushion distortion as a whole, and the vertical deflection coil 15 forms the barrel distortion as a whole. That is, when all of the distortion from the side of the electron gun to the side of the screen of the deflection yoke 11 is integrated, the pin cushion distortion is formed as a whole. For example, the horizontal deflection coil forms the barrel distortion at the electron gun side of the deflection yoke 11, the pin cushion distortion in the mid-section of the deflection yoke 11 and the barrel distortion at the screen side of the deflection yoke, and the distortion in the whole area of the deflection yoke, which is an integration of these three distortions is the pin cushion distortion. The same thing can be applied to the vertical deflection coil 15.

Next, the size of each part of the deflection yoke 11 will be explained. In an example of the present invention, the cone portion of the coils does not include the radically-extending flange portions. In an example of the present invention, the distance C between the end 17 of the cone part of the horizontal deflection coil 14 at the side of the screen and the reference line 13 is 25 mm or longer. Hereinafter, the size of each part of the deflection yoke of an exemplary embodiment, in which the distance C is set to be 30 mm will be explained.

The distance E between the end 17*a* of the cone part of the horizontal deflection coil 14 at the side of the electron gun and the reference line 13 is set to be 53 mm. The distance F between the end 18 of the cone part of the vertical deflection coil 15 at the side of the screen and the reference line 13 is set to be 22 mm. The distance G between the end 18*a* of the cone part of the vertical deflection coil 15 at the side of the electron gun and the reference line 13 is set to be 47 mm.

The distance H between the end 19 of the ferrite core 20 at the side of the screen and the reference line 13 is set to be 20 mm. The distance J between the end 19*a* of the ferrite core 20 at the side of the electron gun and the reference line 13 is set to be 45 mm.

In a conventional type deflection yoke, the distance C is in a range between 16 mm and 23 mm. However, in an example of this invention, the distance C is 25 mm or longer, for example, in the above-mentioned example, the distance C is set to be 30 mm. Accordingly, in comparison with the conventional type, in the example of the present invention, the deflection center of the horizontal deflection coil 14 is shifted to the side of the screen.

As a result, the pin cushion distortion of raster in the upper-and-lower side is strengthened. However, the barrel distortion of raster in the upper-and-lower side is strengthened by expanding the length of the horizontal deflection coil 14, and therefore the pin cushion is cancelled by the barrel distortion, and as a result, the pin cushion distortion can be corrected automatically. The details will be explained referring to FIG. 4.

When the length of the ferrite core 20 is constant, and only the length of the horizontal deflection coil 14 at the side of the screen is expanded, an expanded area of the horizontal deflection coil 14 not covered with the ferrite core 20 will be present. The pin cushion distortion which is further strengthened can be obtained by providing the expanded part of the horizontal deflection coil which is not covered with the ferrite core 20. This is because the ferrite core 20 has a function to strengthen the magnetic field generated by the coil, and at the same time, has a function to uniform the distortion of the magnetic field.

Accordingly, in order to obtain the pin cushion distortion which is further strengthened, a part of the horizontal deflection coil which is not covered with the ferrite core 20 has to be provided. In order to provide the part of the horizontal deflection coil which is not covered with the ferrite core 20, it is preferable that the distance H between the end 19 of the ferrite core 20 at the side of the screen and the reference line 13 is less than 25 mm, while in the example of the present invention, the distance C between the horizontal deflection coil 14 and the reference line 13 is 25 mm or longer.

Next, the winding angle of the horizontal deflection coil 14 will be explained. In the example of the present invention, the winding angle of the distance C is set to be not less than 0 degree nor more than 30 degree to obtain the appropriate pin cushion distortion. Hereinafter, the more details will be explained.

Figure 3:
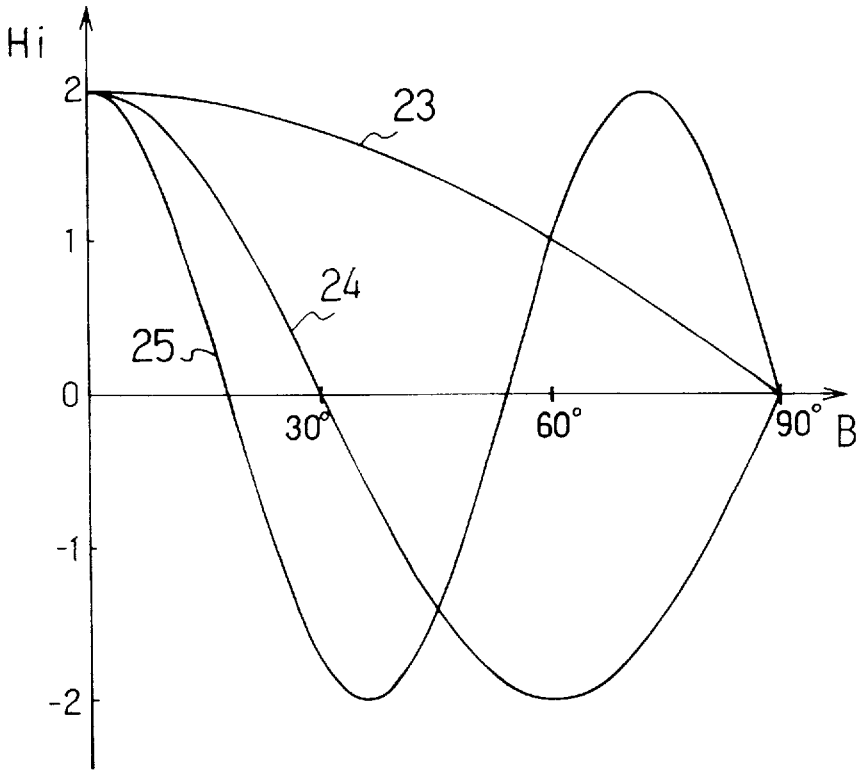
FIG. 3 illustrates the relationship of winding angle B and the coefficient of distortion of magnetic field Hi.

A winding angle is set by a method which is disclosed in publication of Japanese Patent Application Tokko Sho 58-21772. FIG. 3 is a view showing the relation of winding angle B and the coefficient of distortion of the magnetic field Hi. A line 23 indicates the distortion coefficient in the axis, a line 24 indicates the distortion coefficient of the secondary distortion component and a line 25 indicates the distortion coefficient of the quaternary distortion component. When the distortion coefficient of line 23 is $H_0$, the distortion coefficient of line 24 is $H_2$, and the distortion coefficient of line 25 is $H_4$ in the same winding angle B, and r indicates the distance from the center axis of the horizontal deflection coil 14, the magnetic field distortion H is obtained by the following formula.

$$H=H_0+H_2r^2+H_4r^4$$

According to the formula, it was found that the pin cushion distortion is strengthened most when the winding angle is not less than 0 degree nor more than 30 degree.

Hereinafter, the automatic correction in an example of the present invention will be explained concretely referring to the test result shown in FIG. 4. A cathode ray tube apparatus, whose deflection angle is 100 degree and which comprises a 2R-type panel, was used to measure the test result shown in FIG. 4.

Figure 4:
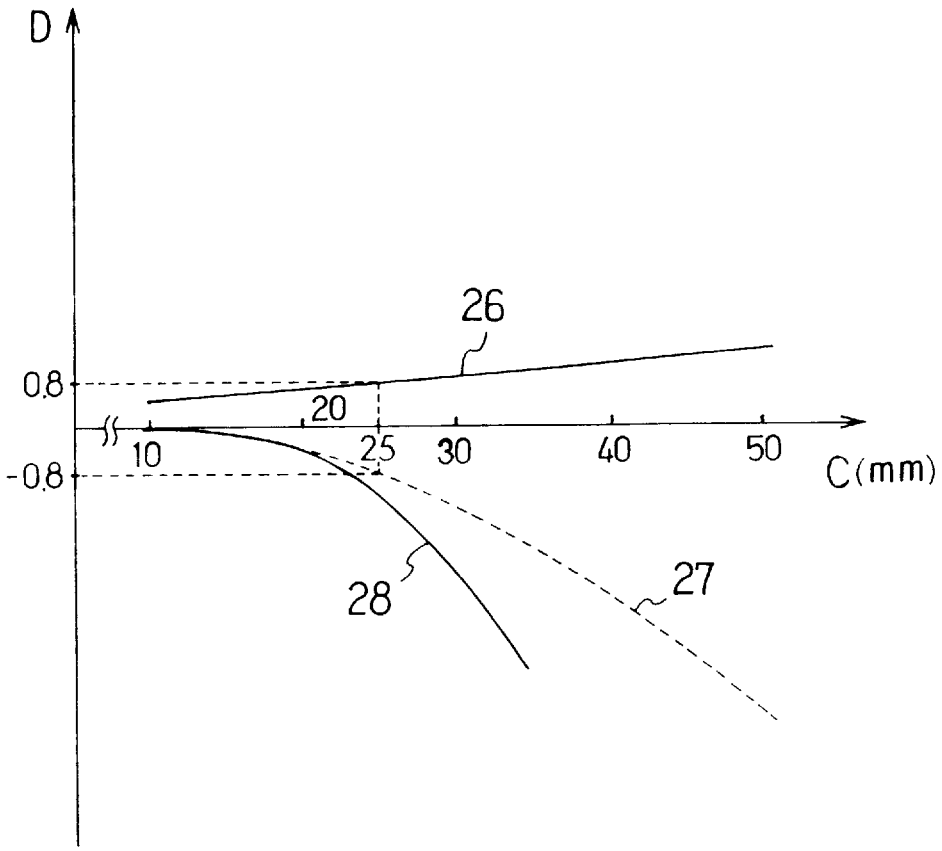
FIG. 4 illustrates the relationship of the distance C and the change of the distortion of raster caused by shifting the deflection center, the relationship of the distance C and the change of the distortion of raster caused by extending the length of the horizontal coil and the ferrite core, and the relationship of the distance C and the change of distortion of raster caused by extending only the length of the horizontal coil.
Figure 5:
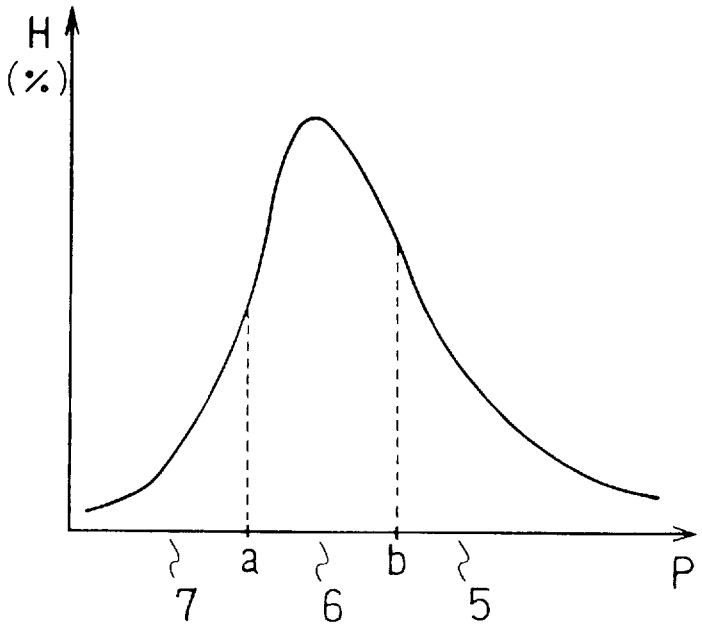
FIG. 5 (PRIOR ART)
FIG. 5 illustrates the relationship of the magnetic field H which is generated from the deflection yoke and the position of P along the longitudinal axis of the picture tube.
Figure 6:
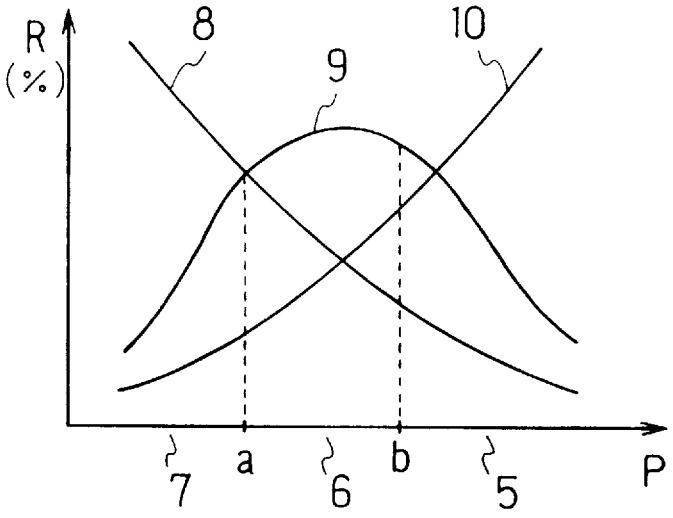
FIG. 6 (PRIOR ART)
FIG. 6 illustrates the relationship of the position of P along the longitudinal axis of the cathode ray tube and the contributing ratio of the magnetic field R to each property.
Figure 7:
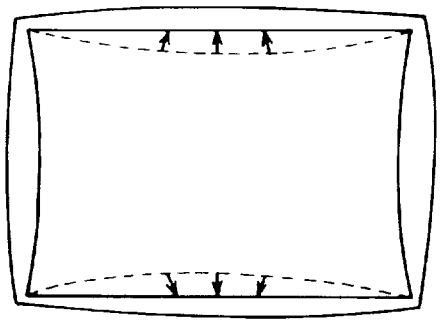
FIG. 7 (PRIOR ART)
FIG. 7 is a view showing an example in which the pin cushion distortion is corrected automatically.
Figure 8:
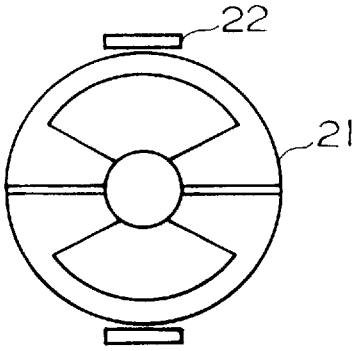
FIG. 8 (PRIOR ART)
FIG. 8 is a view showing a conventional example in which a magnet is attached to the upper-and-lower side of the opening part of the deflection yoke.

The horizontal axis C as shown in FIG. 4 is identical to the distance C as shown in FIG. 2. An area where the value in the horizontal axis C is 25 mm or longer shows the test result of the example of the present invention. For example, an area where the value in the horizontal axis C is 30 mm shows the measured result of the example of the present invention in which the distance C as shown in FIG. 2 is 30 mm.

The vertical axis D as shown in FIG. 4 shows the distortion of raster in the upper-and-lower side of the picture. The part which is above the horizontal axis C shows the pin cushion distortion and the part which is under the horizontal axis C shows the barrel distortion.

The line 26 indicates an effect caused by shifting the deflection center. The line 27 indicates an effect caused by extending the length of the horizontal deflection coil 14. In this case, when the length of the horizontal deflection coil 14 is expanded, the same length of the ferrite core 20 is expanded. The line 28 indicates an effect caused by extending the length of the horizontal deflection coil 14 and an effect caused by providing a part of the horizontal deflection coil which is not covered with the ferrite core. That is, a cathode ray tube apparatus whose length of the horizontal deflection coil is expanded and the length of the ferrite core is not expanded was used to obtain the measured result of the line 28.

As shown in the line 26 in FIG. 4, when the length of the horizontal deflection coil 14 is expanded while maintaining the magnetic field of the horizontal deflection coil 14 at the side of the screen to be constant, the pin cushion distortion of raster in the upper-and-lower side of the picture increases gradually.

On the other hand, when the length of the horizontal deflection coil 14 is expanded and the barrel distortion is strengthened at the side of the electron gun and the pin cushion distortion is strengthened at the side of the screen in order to maintain the convergence in the horizontal axis, as shown in the lines 27 and 28, the distortion of raster in the upper-and-lower side of the picture becomes the barrel distortion gradually. Particularly, as shown in the line 28, it was found that the pin cushion distortion is strengthened rapidly, and the barrel distortion in the upper-and-lower side of the picture is strengthened steeply by the effect caused by increasing the part of the horizontal deflection coil 14 which is not covered with the ferrite core 20.

As shown in FIG. 4, in the example in which the distance C is 25 mm, the pin cushion distortion as shown in the line 26 is 0.8 and the barrel distortion as shown in the line 27 is −0.8, and therefore the absolute value of both is the same. The barrel distortion as shown in the line 28 is strengthened further than that of the pin cushion distortion as shown in the line 26. Further, when the distance C is longer than 25 mm, the difference between the pin cushion distortion as shown in the line 26 and the barrel distortion as shown in the line 27or 28 is expanded.

According to the above-mentioned relation, in an example of the present invention in which the distance C is 25 mm or longer, the pin cushion distortion as shown in the line 26 is corrected by the barrel distortion as shown in the line 27 or 28. As a whole, the pin cushion distortion of raster in the upper-and-lower side of the picture is corrected automatically.

As above-mentioned, in an example of the present invention, a cathode ray tube apparatus comprising a 2R panel and a deflection tube having 100 degree angle of deflection was used. However, when a cathode ray tube comprising a panel which is further flattened and a deflection tube having a larger angle of deflection is used, the distortion of raster prior to the correction becomes strengthened more. Even in this case, it is possible to correct the pin cushion distortion of raster in the upper-and-lower side by expanding the length of the distance C and strengthening the barrel distortion.

It is preferable that the maximum length of the distance C is 60 mm in order to the maintain a suitable distance between an anode and the edge of the horizontal coil.

In an example of the present invention as shown in FIG. 2, the distance H of the ferrite core 20 at the side of the screen is set to be 20 mm and the distance J of the ferrite core 20 at the side of the electron gun is set to be 45 mm. However, the distances H and J can be shortened by 5 mm or 10 mm if needed.

The invention may be embodied in other specific forms without departing from the spirit or essential characteristics thereof. The embodiments disclosed in this application are to be considered in all respects as illustrative and not restrictive, the scope of the invention being indicated by the appended claims rather than by the foregoing description, all changes that come within the meaning and range of equivalency of the claims are intended to be embraced therein.

What is claimed is:

1. A cathode ray tube apparatus used as an in-line aligned color picture tube comprising:

a deflection yoke comprising a horizontal deflection coil which forms a pin cushion distortion and has a cone portion;

a vertical deflection coil which forms a barrel distortion;

and a ferrite core provided around a periphery of said vertical deflection coil to strengthen magnetic flux, wherein a length of the cone portion of said horizontal deflection coil at a screen side with respect to a reference line whose winding angle is not less than 0 degree nor more than 30 degree is 25 mm or longer, as measured from the reference line.

2. The cathode ray tube apparatus according to claim 1, wherein a resin frame is provided around the periphery of said horizontal deflection coil, which insulates and connects said horizontal deflection coil and said vertical deflection coil.

3. The cathode ray tube apparatus according to claim 1, wherein a distance between an end of said ferrite core at the side of the screen and the reference line is less than 25 mm.

4. The cathode ray tube apparatus according to claim 1, wherein a part of said horizontal deflection coil which is not covered with said ferrite core is provided by providing a space between the end of said ferrite core at the side of the screen and the end of the cone portion of said horizontal deflection coil at the screen side.

* * * * *